US007345655B2

(12) United States Patent
Tachibana et al.

(10) Patent No.: US 7,345,655 B2
(45) **Date of Patent: *Mar. 18, 2008**

(54) PLASMA DISPLAY PANEL DRIVE METHOD

(75) Inventors: Hiroyuki Tachibana, Osaka (JP); Jumpei Hashiguchi, Kyoto (JP); Kenji Ogawa, Osaka (JP); Toshikazu Wakabayashi, Osaka (JP); Tomohiro Murakoso, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 168 days.

This patent is subject to a terminal disclaimer.

(21) Appl. No.: 10/546,913

(22) PCT Filed: Jan. 13, 2005

(86) PCT No.: PCT/JP2005/000622

§ 371 (c)(1),
(2), (4) Date: Aug. 25, 2005

(87) PCT Pub. No.: WO2005/069263

PCT Pub. Date: Jul. 28, 2005

(65) Prior Publication Data

US 2006/0145997 A1 Jul. 6, 2006

(30) Foreign Application Priority Data

Jan. 14, 2004 (JP) ..... 2004-006589

(51) Int. Cl.
*G09G 3/28* (2006.01)

(52) U.S. Cl. ..... 345/60; 345/62; 345/63; 345/66; 345/68

(58) Field of Classification Search ..... 345/60–69, 345/90–99; 315/169.1–169.4
See application file for complete search history.

(56) References Cited

U.S. PATENT DOCUMENTS

| | | | |
|---|---|---|---|
| 6,492,770 | B2 | 12/2002 | Amemiya et al. |
| 6,531,994 | B1 | 3/2003 | Nagano |
| 2001/0011871 | A1 | 8/2001 | Amemiya et al. |

(Continued)

FOREIGN PATENT DOCUMENTS

| | | |
|---|---|---|
| EP | 1 003 149 | 5/2000 |

(Continued)

OTHER PUBLICATIONS

J. S. Choi et al., "High Luminous Efficiency of PDP with 'Twin Cell Structure'", IDW '02, pp. 769-772.

*Primary Examiner*—Vijay Shankar
(74) *Attorney, Agent, or Firm*—Wenderoth, Lind & Ponack, L.L.P.

(57) ABSTRACT

Barrier ribs are disposed on a back substrate so as to separate main discharge cells formed of a display electrode pair and a data electrode which face each other and priming discharge cells formed of a clearance between two adjacent scan electrodes. The top parts of the barrier ribs are formed so as to abut on a front substrate. In a driving method, in an odd-numbered line writing time period, scan pulse Va is sequentially applied to odd-numbered scan electrode $SC_p$ and voltage Vq is applied to even-numbered scan electrode $SC_{p+1}$ to cause priming discharge between scan electrode $SC_{p+1}$ and odd-numbered scan electrode $SC_p$. In an even-numbered line writing time period, scan pulse Va is sequentially applied to even-numbered scan electrode $SC_{p+1}$ and voltage Vq is applied to odd-numbered scan electrode $SC_p$ to cause priming discharge between scan electrode $SC_p$ and even-numbered scan electrode $SC_{p+1}$.

2 Claims, 5 Drawing Sheets

U.S. PATENT DOCUMENTS

| | | | | |
|---|---|---|---|---|
| 2005/0215159 | A1* | 9/2005 | Yamauchi et al. | 445/6 |
| 2006/0284795 | A1* | 12/2006 | Akiyama et al. | 345/60 |
| 2006/0284796 | A1* | 12/2006 | Kigo et al. | 345/60 |

FOREIGN PATENT DOCUMENTS

| | | |
|---|---|---|
| JP | 8-162026 | 6/1996 |
| JP | 9-160525 | 6/1997 |
| JP | 9-319328 | 12/1997 |
| JP | 10-39834 | 2/1998 |
| JP | 10-63222 | 3/1998 |
| JP | 2002-150949 | 5/2002 |
| JP | 2004-29412 | 1/2004 |

* cited by examiner

PLASMA DISPLAY PANEL DRIVE METHOD

This Application is a U.S. National phase application of PCT International Application PCT/JP2005/000622.

TECHNICAL FIELD

The present invention relates to a driving method of a plasma display panel used in a wall-mounted television (TV) or a large monitor.

BACKGROUND ART

A plasma display panel (hereinafter referred to as "PDP" or "panel") is a display device that has a large screen, is thin and light, and has high visibility.

A typical alternating-current surface discharge type panel used as the PDP has many discharge cells between a front plate and a back plate that are faced to each other. The front plate has the following elements:

- a plurality of pairs of display electrodes disposed in parallel on a front glass substrate; and
- a dielectric layer and a protective layer for covering the display electrodes.

Here, each display electrode is formed of a scan electrode and a sustain electrode. The back plate has the following elements:

- a plurality of data electrodes disposed in parallel on a back glass substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and back plate are faced to each other so that the display electrodes and the data electrodes three-dimensionally intersect, and are sealed. Discharge gas is filled into a discharge space in the sealed product. In the panel having this configuration, ultraviolet rays are emitted by gas discharge in each discharge cell. The ultraviolet rays excite respective phosphors of red (R), green (G), and blue (B), emit light, and thus provide color display.

A subfield method is generally used as a method of driving the panel. In this method, one field time period is divided into a plurality of subfields, and the subfields at which light is emitted are combined, thereby performing gradation display. Here, each subfield has an initialization time period, a writing time period, and a sustaining time period.

In the initialization time period, initializing discharge is performed simultaneously in all discharge cells, the history of the wall charge for each discharge cell before the initializing discharge is erased, and wall charge required for a subsequent writing operation is formed. Discharge delay is reduced, and priming (detonating agent for discharge=exciting particle) for stably causing writing discharge is generated. In the writing time period, a scan pulse is sequentially applied to the scan electrodes, a writing pulse corresponding to an image signal to be displayed is applied to the data electrodes, writing discharge is selectively caused between the scan electrodes and the data electrodes, and the wall charge is selectively generated. In the subsequent sustaining time period, a predetermined number of sustaining pulses are applied between the scan electrodes and the sustain electrodes, and discharge and light emission are performed selectively in the discharge cells where the wall charge is generated by writing discharge.

For displaying an image correctly, it is important to certainly perform the selective writing discharge in the writing time period. However, the writing discharge has many factors that increase the discharge delay. The factors are, for example, facts that high voltage cannot be used for the writing pulses because of constraints in circuit configuration and that the phosphor layers formed on the data electrodes suppress the discharge. Therefore, the priming for stably causing the writing discharge becomes extremely important.

However, the priming generated by the discharge rapidly decreases with the passage of time. In the driving method of the panel, in the writing discharge after a lapse of a long time since the initializing discharge, the priming generated by the initializing discharge disadvantageously comes short, thereby increasing the discharge delay, destabilizing the writing operation, and reducing the image display quality. When the writing time period is set long for stabilizing the writing operation, disadvantageously, the time taken for the writing time period excessively increases.

For addressing the problems, a panel for generating the priming using a priming discharge cell disposed on the front plate of the panel and reducing the discharge delay, and a driving method of the panel are disclosed (for example, Japanese Patent Unexamined Publication No. 2002-150949).

In this panel, however, adjacent discharge cells are apt to interfere with each other. Especially, in the writing time period, the priming generated by writing discharge of the adjacent discharge cells can cause a writing error or bad writing, and hence the driving voltage margin of a writing operation becomes narrow.

The present invention addresses the problems, and provides a driving method of a plasma display panel capable of stably causing the writing discharge without reducing the driving voltage margin of the writing operation.

SUMMARY OF THE INVENTION

The present invention provides a driving method of a plasma display panel. The plasma display panel has the following elements:

- a first substrate;
- a plurality of display electrode pairs that are disposed on the first substrate and formed of scan electrodes and sustain electrodes arranged alternately by two and in parallel;
- a second substrate faced to the first substrate through a discharge space;
- a plurality of data electrodes disposed on the second substrate in the direction crossing the display electrode pairs; and
- a barrier rib disposed between the first substrate and second substrate so as to separate main discharge cells for causing main discharge and priming discharge cells that cause priming discharge with two adjacent scan electrodes of the plurality of scan electrodes.

Here, each main discharge cell is formed of a display electrode pair and a data electrode. In this method, one field time period is formed of a plurality of subfields having an initialization time period, a writing time period, and a sustaining time period. The writing time period has an odd-numbered line writing time period and an even-numbered line writing time period. In the odd-numbered line writing time period, a writing operation is performed in the main discharge cell having an odd-numbered scan electrode, and in the even-numbered line writing time period, a writing operation is performed in the main discharge cell having an even-numbered scan electrode. In the odd-numbered line writing time period, a scan pulse is sequentially applied to the odd-numbered scan electrode, and voltage is applied to the even-numbered scan electrode. This voltage is used for causing priming discharge in the priming discharge cell between the even-numbered scan electrode and the odd-numbered scan electrode to which the scan pulse has been applied. In the even-numbered line writing time period, a scan pulse is sequentially applied to the even-numbered scan electrode, and voltage is applied to the odd-numbered scan electrode. This voltage is used for causing priming discharge in the priming discharge cell between the odd-numbered scan electrode and the even-numbered scan electrode to which the scan pulse has been applied.

DETAILED DESCRIPTION OF PREFERRED EMBODIMENTS

First Exemplary Embodiment

Figure 1:
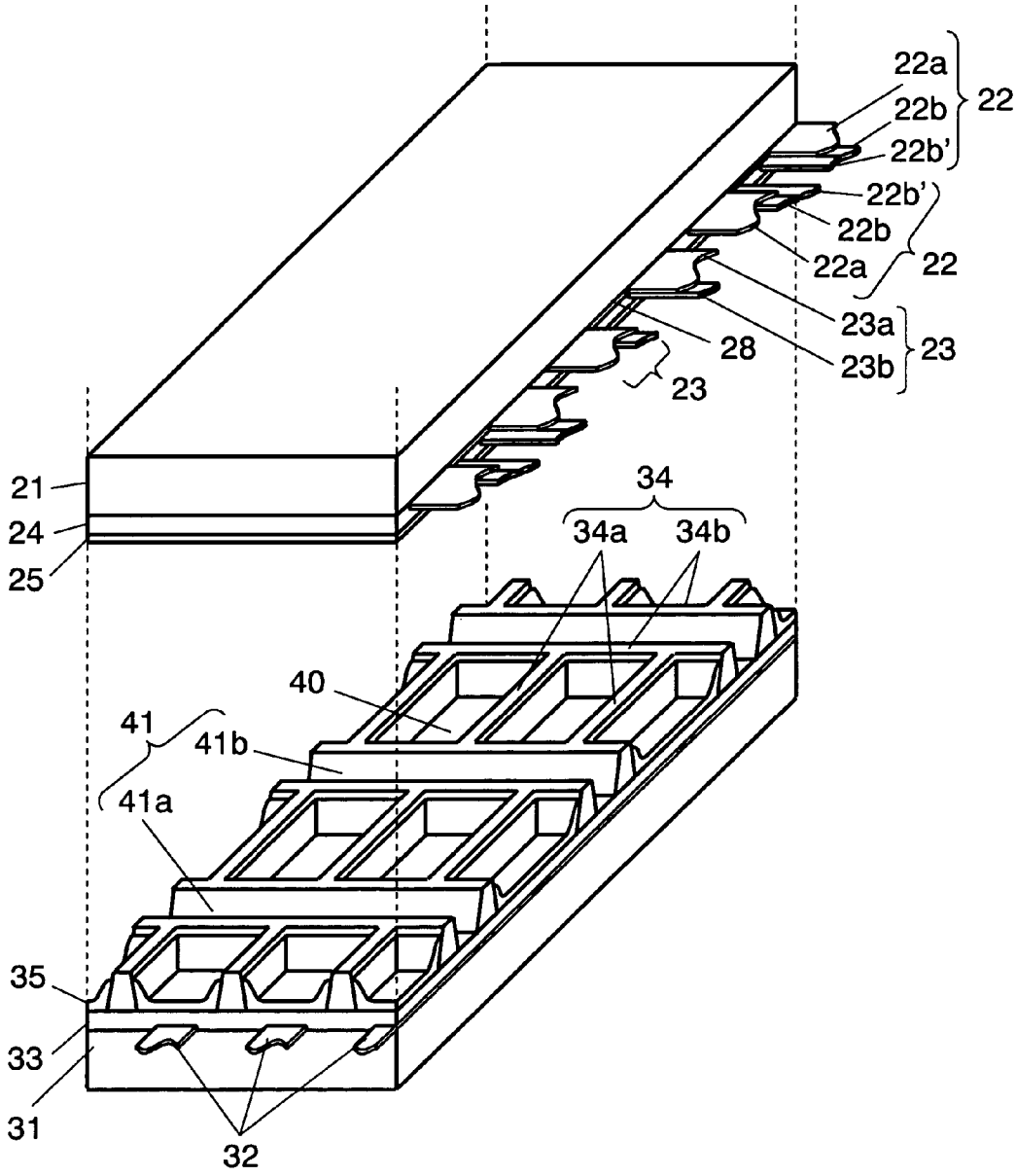
FIG. 1 is an exploded perspective view showing a configuration of a panel in accordance with a first exemplary embodiment of the present invention.
Figure 2:
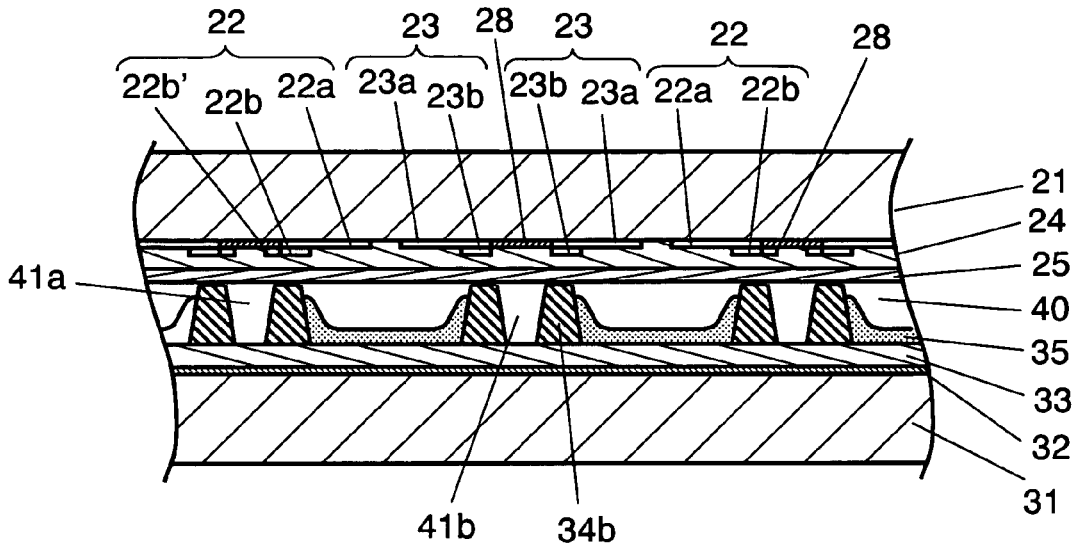
FIG. 2 is a sectional view of the panel.

A panel in accordance with the first exemplary embodiment of the present invention will be described hereinafter with reference to the following drawings. FIG. 1 is an exploded perspective view showing a configuration of the panel in accordance with the first exemplary embodiment of the present invention. FIG. 2 is a sectional view of the panel. Glass front substrate 21 as the first substrate and back substrate 31 as the second substrate are faced to each other on the opposite sides of a discharge space, and the discharge space is filled with mixed gas of neon and xenon. The mixed gas emits ultraviolet rays with discharge.

Display electrode pairs formed of scan electrodes 22 and sustain electrodes 23 are disposed on front substrate 21 in parallel with each other. At this time, scan electrodes 22 and sustain electrodes 23 are arranged alternately by two so as to provide the configuration of sustain electrode 23—scan electrode 22—scan electrode 22—sustain electrode 23—and so forth. Scan electrode 22 and sustain electrode 23 are formed of transparent electrodes 22*a* and 23*a* and metal buses 22*b* and 23*b* disposed on transparent electrodes 22*a* and 23*a*, respectively. Light absorbing layers 28 made of black materials are disposed between scan electrode 22 and scan electrode 22 and between sustain electrode 23 and sustain electrode 23. Projections 22*b*' of metal buses 22*b* of scan electrodes 22 are projected above light absorbing layers 28. Dielectric layer 24 and protective layer 25 are formed so as to cover scan electrodes 22, sustain electrodes 23, and light absorbing layers 28.

A plurality of data electrodes 32 are formed in parallel on back substrate 31 in the intersecting direction with scan electrodes 22 and sustain electrodes 23. Dielectric layer 33 is formed so as to cover data electrodes 32. Barrier ribs 34 for separating main discharge cells 40 are formed on dielectric layer 33.

Each barrier rib 34 is formed of longitudinal wall unit 34*a* extending in parallel with data electrodes 32 and lateral wall unit 34*b* that forms main discharge cells 40 and forms clearance unit 41 between main discharge cells 40. As a result, barrier ribs 34 form a main discharge cell row having a plurality of main discharge cells 40 interconnected along a display electrode pair, and form clearance unit 41 between adjacent main discharge cell rows. Here, the display electrode pair is formed of a pair of scan electrode and sustain electrode, as discussed above. Projection 22*b*' is formed in clearance unit lying on the side of two adjacent scan electrodes, of clearance units 41, and this clearance unit works as priming discharge cell 41*a*. In other words, clearance units 41 have projection 22*b*' and hence work as priming discharge cells 41*a* every other unit. Clearance unit 41*b* lies on the side of two adjacent sustain electrodes.

Top parts of barrier ribs 34 are formed flat so as to abut on front substrate 21. This shape is employed for preventing interference between adjacent discharge cells, especially preventing a malfunction such as a writing error from being caused by the priming that is generated by writing discharge of the adjacent discharge cells in the writing time period. Further, this shape is employed for preventing a malfunction where the wall charge of main discharge cell 40 adjacent to priming discharge cell 41*a* decreases to cause bad writing. In the first embodiment of the present invention, the step height of barrier ribs 34 is set at 10 μm or shorter. This value is determined based on an experimental result where adjacent main discharge cells 40 interfere with each other at step height of 10 μm or longer and hence priming discharge cell 41*a* and main discharge cell 40 interfere with each other.

Phosphor layers 35 are formed on the side surfaces of barrier ribs 34 and the surfaces of dielectric layer 33 corresponding to main discharge cells 40 separated by barrier ribs 34. Phosphor layer 35 is not formed on the priming discharge cell 41 side in FIG. 1; however, phosphor layer 35 may be formed.

Dielectric layer 33 is formed so as to cover data electrodes 32 in the above description; however, dielectric layer 33 is not necessarily required.

Figure 3:
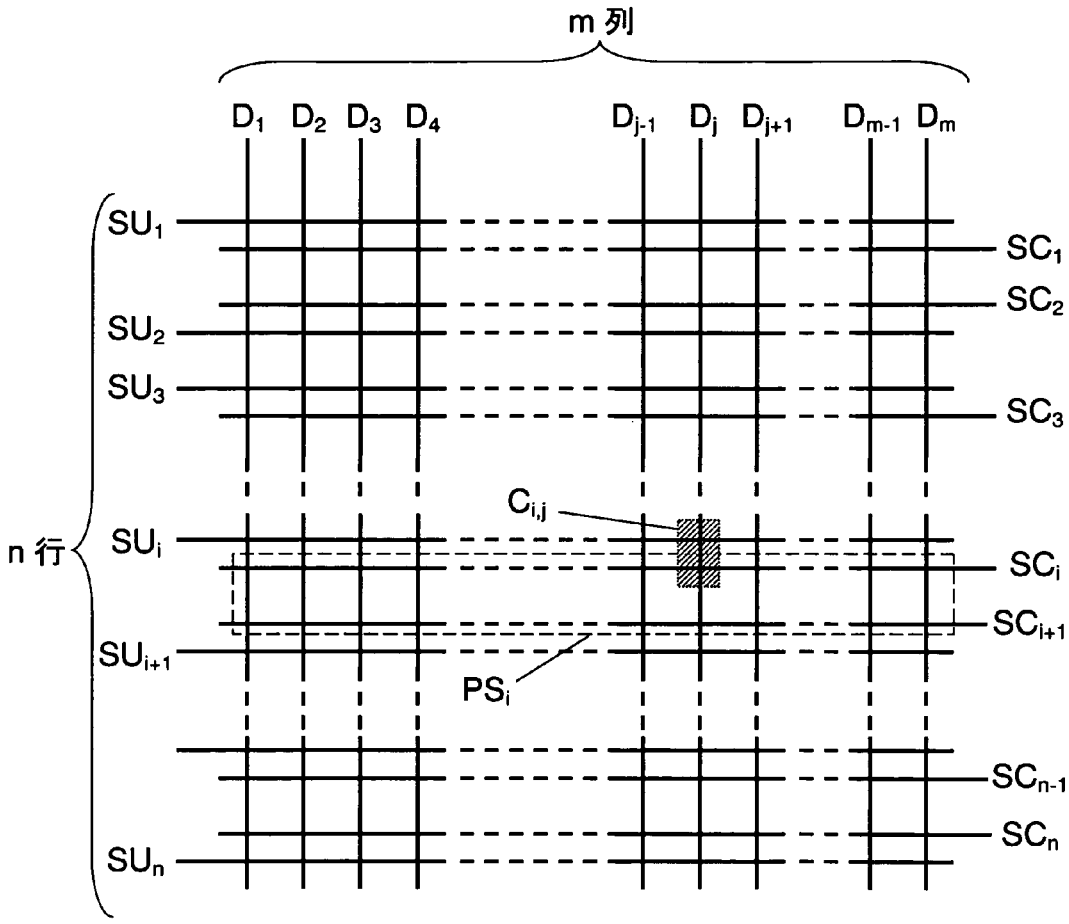
FIG. 3 is an electrode array diagram of the panel.

FIG. 3 is an electrode array diagram of the panel of the first embodiment of the present invention. In the row direction, m rows of data electrodes $D_1$ to $D_m$ (data electrodes 32 in FIG. 1) are disposed. In the column direction, n columns of scan electrodes $SC_1$ to $SC_n$ (scan electrodes 22 in FIG. 1) and n columns of sustain electrodes $SU_1$ to $SU_n$ (sustain electrodes 23 in FIG. 1) are disposed alternately by two so as to provide the configuration of sustain electrode $SU_1$—scan electrode $SC_1$—scan electrode $SC_2$—sustain electrode $SU_2$—and so forth. In the first embodiment of the present invention, priming discharge is performed between projections (projections 22*b*' in FIG. 1) of adjacent scan electrodes $SC_p$ and $SC_{p+1}$ (p=odd number).

Main discharge cell $C_{i,j}$ (main discharge cell 40 in FIG. 1) including a pair of electrodes, namely scan electrode $SC_i$ (i=1 to n) and sustain electrode $SU_i$, and one data electrode $D_j$ (j=1 to m) is formed in an m×n array in the discharge space. Priming discharge cell $PS_p$ (priming discharge cell 41*a* in FIG. 1) including the projection of scan electrode $SC_p$ and the projection of sustain electrode $SU_{p+1}$ is formed.

Next, a driving waveform for driving the panel, its timing, and an operation of the panel are described hereinafter.

Figure 4:
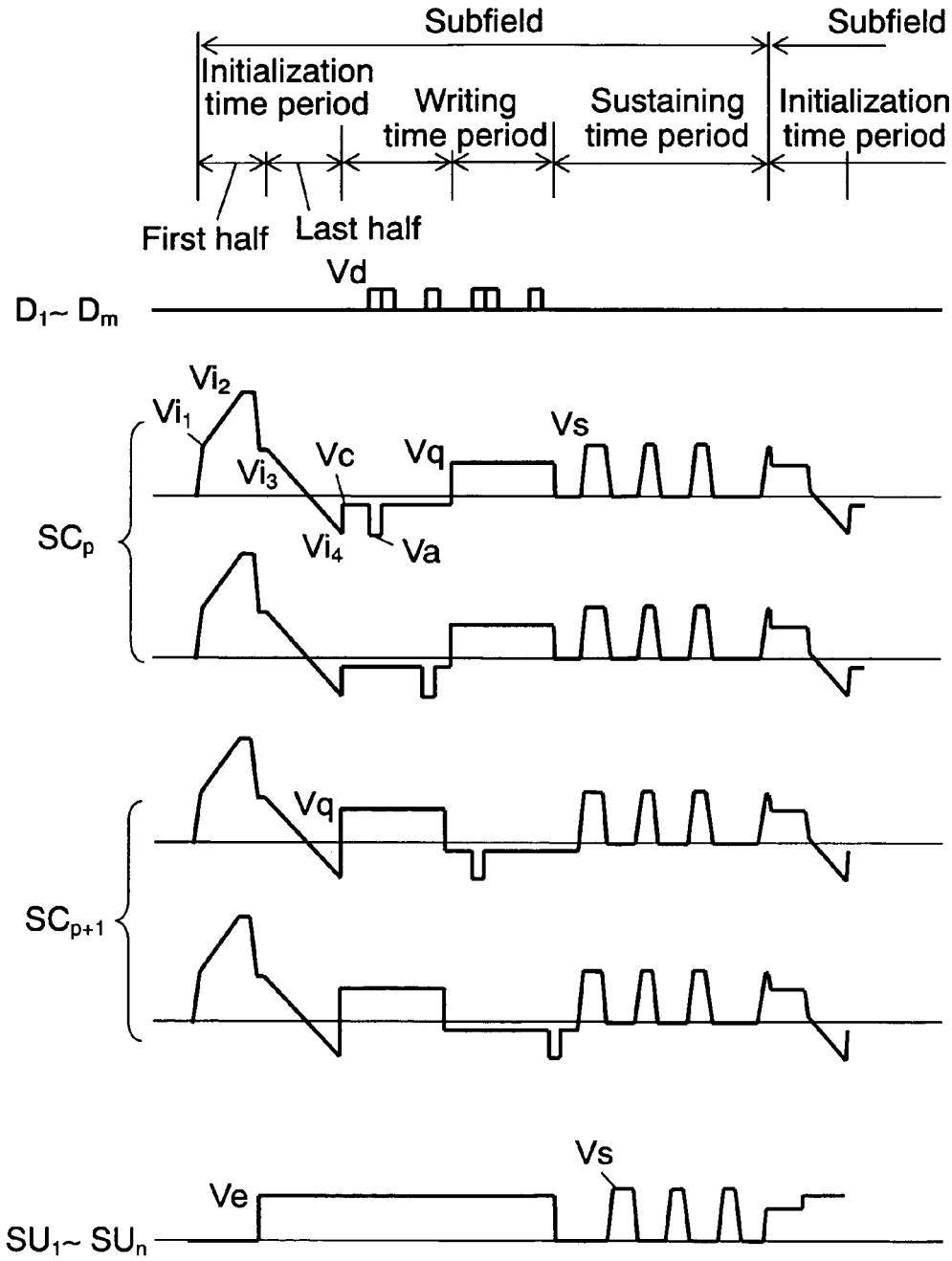
FIG. 4 is a driving waveform diagram of the panel.

FIG. 4 is a driving waveform diagram of the panel of the first exemplary embodiment of the present invention. One field time period is formed of a plurality of subfields having an initialization time period, a writing time period, and a sustaining time period, in the first embodiment. The writing time period has an odd-numbered line writing time period and an even-numbered line writing time period. In the odd-numbered line writing time period, a writing operation is performed in main discharge cells having odd-numbered scan electrodes, and in the even-numbered line writing time period, a writing operation is performed in main discharge cells having even-numbered scan electrodes. The writing operations of the odd-numbered scan electrode and the even-numbered scan electrode are performed temporally separately. As described below, this operation method is employed for causing the priming discharge using the wall charge sequentially, continuously, and stably. This method can reduce influence of interaction between discharge cells, especially influence of vertically adjacent main discharge cells in the writing time period.

In the first half of the initialization time period, data electrodes $D_1$ to $D_m$ and sustain electrodes $SU_1$ to $SU_n$ are kept 0 (V), and a ramp waveform voltage gradually increasing from voltage $Vi_1$ toward voltage $Vi_2$ is applied to scan electrodes $SC_1$ to $SC_n$. Here, voltage $Vi_1$ is set so that the voltage difference between sustain electrodes $SU_1$ to $SU_n$ and scan electrodes $SC_1$ to $SC_n$ is not higher than the discharge start voltage, and voltage $Vi_2$ is set so that the voltage difference is higher than the discharge start voltage. The first feeble initializing discharge occurs between scan electrodes $SC_1$ to $SC_n$ and sustain electrodes $SU_1$ to $SU_n$, and the first feeble initializing discharge occurs between scan electrodes $SC_1$ to $SC_n$ and data electrodes $D_1$ to $D_m$, respectively, while the ramp waveform voltage increases. Negative wall voltage is accumulated on scan electrodes $SC_1$ to $SC_n$, and positive wall voltage is accumulated on data electrodes $D_1$ to $D_m$ and sustain electrodes $SU_1$ to $SU_n$. Here, the wall voltage on the electrodes means the voltage generated by the wall charges accumulated on the dielectric layer covering the electrodes or on the phosphor layer. At this time, scan electrodes $SC_1$ to $SC_n$ are at an equal voltage, and hence cause no discharge in priming discharge cell $PS_p$.

In the last half of the initialization time period, sustain electrodes $SU_1$ to $SU_n$ are kept at positive voltage Ve, and a ramp waveform voltage gradually decreasing from voltage $Vi_3$ toward voltage $Vi_4$ is applied to scan electrodes $SC_1$ to $SC_n$. Here, voltage $Vi_3$ is set so that the voltage difference between sustain electrodes $SU_1$ to $SU_n$ and scan electrodes $SC_1$ to $SC_n$ is not higher than the discharge start voltage, and voltage $Vi_4$ is set so that the voltage difference is higher than the discharge start voltage. The second feeble initializing discharges occur between scan electrodes $SC_1$ to $SC_n$ and sustain electrodes $SU_1$ to $SU_n$, and the second feeble initializing discharges occur between scan electrodes $SC_1$ to $SC_n$ and data electrodes $D_1$ to $D_m$, respectively, while the ramp waveform voltage decreases. The negative wall voltage on scan electrodes $SC_1$ to $SC_n$ and positive wall voltage on sustain electrodes $SU_1$ to $SU_n$ are reduced, positive wall voltage on data electrodes $D_1$ to $D_m$ is adjusted to a value suitable for the writing operation. At this time, also, scan electrodes $SC_1$ to $SC_n$ are at an equal voltage, and hence cause no discharge in priming discharge cell $PS_p$. Thus, the initializing operation is finished.

In the odd-numbered line writing time period, odd-numbered scan electrode $SC_p$ is temporarily kept at voltage Vc. Voltage Vq is applied to even-numbered scan electrode $SC_{p+1}$ to cause discharge in priming discharge cell $PS_p$ between scan electrode $SC_{p+1}$ and odd-numbered scan electrode $SC_p$ adjacent to it. Next, when scan pulse voltage Va is applied to first scan electrode $SC_1$, priming discharge occurs in priming discharge cell $PS_1$ between scan electrode $SC_1$ and second scan electrode $SC_2$, and the priming is supplied into main discharge cells $C_{1,1}$ to $C_{1,m}$. At this time, when positive writing pulse Vd is applied to data electrode $D_k$ (k is integer 1 to m) corresponding to an image signal to be displayed, discharge occurs in the intersecting part of data electrode $D_k$ and scan electrode $SC_1$ and results in discharge between sustain electrode $SU_1$ and scan electrode $SC_1$ of corresponding discharge cell $C_{1,k}$. Positive wall voltage is accumulated on scan electrode $SC_1$ in main discharge cell $C_{1,k}$, negative wall voltage is accumulated on sustain electrode $SU_1$, and the writing operation of the first row is finished. At this time, positive wall voltage is accumulated on scan electrode $SC_1$ and negative wall voltage is accumulated on scan electrode $SC_2$ in priming discharge cell $PS_1$.

Similarly, the writing operations of odd-numbered main discharge cells $C_{3,k}$, $C_{5,k}$, and so forth are performed.

In the even-numbered line writing time period, even-numbered scan electrode $SC_{p+1}$ is temporarily kept at voltage Vc. Voltage Vq is applied to odd-numbered scan electrode $SC_p$ to cause discharge in priming discharge cell $PS_p$ between scan electrode $SC_p$ and odd-numbered scan electrode $SC_{p+1}$ adjacent to it. Next, when scan pulse voltage Va is applied to second scan electrode $SC_2$, priming discharge occurs in priming discharge cell $PS_1$ between scan electrode $SC_2$ and first scan electrode $SC_1$. This priming discharge becomes stable and its discharge delay is reduced, because the positive wall voltage accumulated on scan electrode $SC_1$ in priming discharge cell $PS_1$ and the negative wall voltage accumulated on sustain electrode $SC_2$ are added. The priming is supplied into main discharge cells $C_{2,1}$ to $C_{2,m}$. At this time, when positive writing pulse Vd is applied to data electrode $D_k$ corresponding to the image signal to be displayed, discharge occurs in the intersecting part of data electrode $D_k$ and scan electrode $SC_2$ and results in discharge between sustain electrode $SU_2$ and scan electrode $SC_2$ of corresponding discharge cell $C_{2,k}$. Positive wall voltage is accumulated on scan electrode $SC_2$ in main discharge cell $C_{2,k}$, negative wall voltage is accumulated on sustain electrode $SU_2$, and the writing operation of the second row is finished. At this time, the wall voltages in priming discharge cell $PS_1$ are inverted, negative wall voltage is accumulated on scan electrode $SC_1$ in priming discharge cell $PS_1$, and positive wall voltage is accumulated on scan electrode $SC_2$.

Similarly, the writing operations of even-numbered main discharge cells $C_{4,k}$, $C_{6,k}$, and so forth are performed. The writing time period is thus finished.

In the sustaining time period, scan electrodes $SC_1$ to $SC_n$ and sustain electrodes $SU_1$ to $SU_n$ are temporarily returned to 0 (V), and then positive sustaining pulse voltage Vs is applied to scan electrodes $SC_1$ to $SC_n$. At this time, the voltage between the upper parts of scan electrode $SC_i$ and sustain electrode $SU_i$ in discharge cell $C_{i,k}$ having undergone writing discharge becomes higher than the discharge start voltage. That is because positive sustaining voltage Vs and the wall voltages accumulated on scan electrode $SC_i$ and sustain electrode $SU_i$ in the writing time period are added to the discharge start voltage. Thus, sustaining discharge occurs in discharge cell $C_{i,k}$. After that, similarly, sustaining pulses are alternately applied to scan electrodes $SC_1$ to $SC_n$ and sustain electrodes $SU_1$ to $SU_n$. Thus, sustaining discharge is continuously repeated by the number of sustaining pulses in discharge cell $C_{i,k}$ having undergone writing discharge. At this time, scan electrodes $SC_1$ to $SC_n$ are at an equal voltage, and hence cause no discharge in priming discharge cell $PS_p$.

In the initialization time period of a subsequent subfield, sustain electrodes $SU_1$ to $SU_n$ are kept at positive voltage Ve, and a ramp waveform voltage gradually decreasing toward voltage $Vi_4$ is applied to scan electrodes $SC_1$ to $SC_n$. In main discharge cell $C_{i,k}$ where sustaining discharge has occurred, feeble initializing discharge occurs between scan electrodes $SC_1$ to $SC_n$ and sustain electrodes $SU_1$ to $SU_n$ and feeble initializing discharge occurs between scan electrodes $SC_1$ to $SC_n$ and data electrodes $D_1$ to $D_m$. The wall voltage on scan electrodes $SC_1$ to $SC_n$ and the wall voltage on sustain electrodes $SU_1$ to $SU_n$ are decreased, and the positive wall voltage on data electrodes $D_1$ to $D_m$ is adjusted to a voltage suitable for the writing operation. At this time, also, scan electrodes $SC_1$ to $SC_n$ are at an equal voltage, and hence cause no discharge in priming discharge cell $PS_p$.

Operations in the writing time period and the sustaining time period after the initialization time period, the driving waveform of a subsequent subfield, and the operation of the panel are the same as those discussed above.

Here, an operation of a priming discharge cell is especially described again, for describing the reason why the writing time period is divided into the odd-numbered line writing time period and even-numbered line writing time period. In priming discharge cell $PS_p$, discharge occurs only when the voltage applied to odd-numbered scan electrode $SC_p$ is different from voltage applied to even-numbered scan electrode $SC_{p+1}$, so that the attention is required to be focused only on the writing time period.

In the odd-numbered line writing time period of the initial subfield, negative scan pulse voltage Va is applied to odd-numbered scan electrode $SC_p$, and positive voltage Vq is applied to even-numbered scan electrode $SC_{p+1}$, thereby causing priming discharge. Positive wall voltage is accumulated on odd-numbered scan electrode $SC_p$, and negative wall voltage is accumulated on even-numbered scan electrode $SC_{p+1}$, in priming discharge cell $PS_p$.

In the subsequent even-numbered line writing time period, negative scan pulse voltage Va is further applied to even-numbered scan electrode $SC_{p+1}$ on which the negative wall voltage is accumulated, and positive voltage Vq is further applied to odd-numbered scan electrode $SC_p$ on which the positive wall voltage is accumulated, thereby causing priming discharge. Thus, this priming discharge becomes stable and its discharge delay is reduced, because the wall voltages are further added to the voltages that have been applied to the electrodes. Then, positive wall voltage is accumulated on even-numbered scan electrode $SC_{p+1}$, and negative wall voltage is accumulated on odd-numbered scan electrode $SC_p$, in priming discharge cell $PS_p$.

In the odd-numbered line writing time period of the next subfield, negative scan pulse voltage Va is further applied to odd-numbered scan electrode $SC_p$ on which the negative wall voltage is accumulated, and positive voltage Vq is further applied to even-numbered scan electrode $SC_{p+1}$ on which the positive wall voltage is accumulated, thereby causing priming discharge. Thus, this priming discharge also becomes stable and its discharge delay is reduced. Then, positive wall voltage is accumulated on odd-numbered scan electrode $SC_p$, and negative wall voltage is accumulated on even-numbered scan electrode $SC_{p+1}$, in priming discharge cell $PS_p$.

After that, similarly, the wall voltages always work to increase the priming discharge, so that the priming discharge also becomes stable and its discharge delay is reduced. Thus, by dividing the writing time period into the odd-numbered line writing time period and even-numbered line writing time period, the priming discharge can be made stable and its discharge delay can be reduced.

In the above-mentioned description, in the initialization time period of the first subfield, a full cell initializing operation of performing initializing discharge in all main discharge cells is performed. In the initialization time periods of the next subfield and later, a selective initializing operation is performed where the main discharge cell having undergone sustaining discharge is selectively initialized. However, these initializing operations may be arbitrarily combined.

Second Exemplary Embodiment

The configuration of the panel in accordance with the second exemplary embodiment of the present invention is the same as that of the first exemplary embodiment. In the driving method of the second exemplary embodiment, the writing time period is divided into an odd-numbered line writing time period and an even-numbered line writing time period, and these time periods are performed temporally separately, similarly to that of the first exemplary embodiment. The second exemplary embodiment differs from the first exemplary embodiment in that the second embodiment has subfields where the initialization time period is temporally separately divided into an odd-numbered line initialization time period and an even-numbered line initialization time period. In other words, of a plurality of subfields, at least one subfield has the odd-numbered line initialization time period in which main discharge cells having odd-numbered scan electrodes are initialized and the even-numbered line initialization time period in which main discharge cells having even-numbered scan electrodes are initialized. The odd-numbered line initialization time period is disposed just before the odd-numbered line writing time period, and the even-numbered line initialization time period is disposed just before the even-numbered line writing time period.

Figure 5:
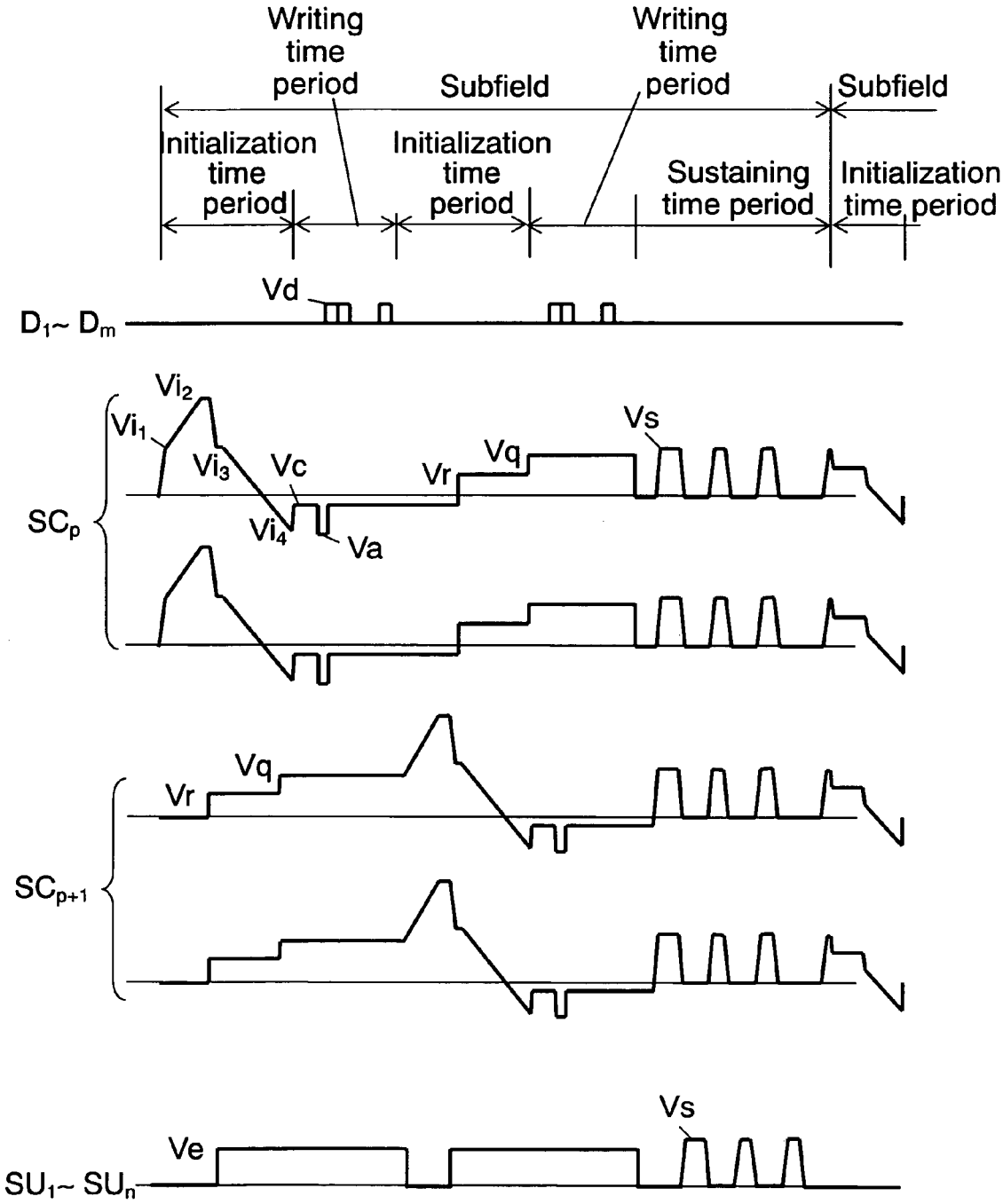
FIG. 5 is a driving waveform diagram of a panel in accordance with a second exemplary embodiment of the present invention.

Next, a driving waveform for driving the panel, its timing, and an operation of the panel are described hereinafter. FIG. 5 is a driving waveform diagram of the panel of the second exemplary embodiment of the present invention.

In the first half of the odd-numbered line initialization time period, data electrodes $D_1$ to $D_m$ and sustain electrodes $SU_1$ to $SU_n$ are kept 0 (V), and a ramp waveform voltage gradually increasing from voltage $Vi_1$ toward voltage $Vi_2$ is applied to odd-numbered scan electrode $SC_p$. While the ramp waveform voltage increases, the first feeble initializing discharge occurs in the odd-numbered main discharge cell, negative wall voltage is accumulated on odd-numbered scan electrodes $SC_p$, and positive wall voltage is accumulated on data electrodes $D_1$ to $D_m$ and odd-numbered sustain electrodes $SU_p$. In the last half of the odd-numbered line initialization time period, sustain electrodes $SU_1$ to $SU_n$ are kept at positive voltage Ve, and a ramp waveform voltage gradually decreasing from voltage $Vi_3$ toward voltage $Vi_4$ is applied to odd-numbered scan electrodes $SC_p$. While the ramp waveform voltage decreases, the second feeble initializing discharge occurs in the odd-numbered main discharge cell, the negative wall voltage on odd-numbered scan electrodes $SC_p$ and positive wall voltage on odd-numbered sustain electrodes $SU_p$ are reduced, positive wall voltage on data electrodes $D_1$ to $D_m$ is adjusted to a value suitable for the writing operation.

The discharge occurring in the odd-numbered main discharge cell and the behavior of the wall voltage following the discharge have been described. No discharge occurs in main discharge cells on the even-numbered line side.

At this time, the discharge and wall voltage behave as follows in priming discharge cell $PS_p$. In the first half of the odd-numbered line initialization time period, even-numbered scan electrode $SC_{p+1}$ is kept 0 (V), and a ramp waveform voltage gradually increasing toward voltage $Vi_2$ exceeding the discharge start voltage is applied to odd-numbered scan electrode $SC_p$. Therefore, first feeble initializing discharge occurs between odd-numbered scan electrode $SC_p$ and even-numbered scan electrode $SC_{p+1}$. Negative wall voltage is accumulated on odd-numbered scan electrodes $SC_p$, and positive wall voltage is accumulated on even-numbered scan electrode $SC_{p+1}$, in priming discharge cell $PS_p$. In the last half of the odd-numbered line initialization time period, a ramp waveform voltage gradually decreasing from voltage $Vi_3$ toward voltage $Vi_4$ is applied to odd-numbered scan electrodes $SC_p$. However, voltage Vr for suppressing discharge is applied to even-numbered scan electrode $SC_{p+1}$. Therefore, discharge does not occur in this electrode, or even if discharge occurs the wall voltages are not largely reduced.

Thus, before the odd-numbered line writing time period, negative wall voltage is accumulated on odd-numbered scan electrodes $SC_p$ and positive wall voltage is accumulated on even-numbered scan electrode $SC_{p+1}$ in priming discharge cell $PS_p$.

In the subsequent odd-numbered line writing time period, negative scan pulse voltage Va is further applied to odd-numbered scan electrode $SC_p$ on which the negative wall voltage has been accumulated, and positive voltage Vq is further applied to even-numbered scan electrode $SC_{p+1}$ on which the positive wall voltage has been accumulated, thereby causing priming discharge. Thus, the priming discharge in the writing time period of the first subfield also becomes stable, and its discharge delay is reduced. Then, positive wall voltage is accumulated on odd-numbered scan electrode $SC_p$ and negative wall voltage is accumulated on even-numbered scan electrode $SC_{p+1}$ in priming discharge cell $PS_p$.

In the first half of the even-numbered line initialization time period, data electrodes $D_1$ to $D_m$ and sustain electrodes $SU_1$ to $SU_n$ are kept 0 (V), and a ramp waveform voltage gradually increasing from voltage $Vi_1$ toward voltage $Vi_2$ is applied to even-numbered scan electrode $SC_{p+1}$. In the last half of the even-numbered line initialization time period, sustain electrodes $SU_1$ to $SU_n$ are kept at positive voltage Ve, and a ramp waveform voltage gradually decreasing from voltage $Vi_3$ toward voltage $Vi_4$ is applied to even-numbered scan electrodes $SC_p$. In this time period, an initializing operation similar to that in the odd-numbered main discharge cell is performed in the even-numbered main discharge cell.

At this time, the positive wall voltage has been accumulated on odd-numbered scan electrode $SC_p$ and negative wall voltage has been accumulated on even-numbered scan electrode $SC_{p+1}$ in priming discharge cell $PS_p$. Therefore, even when the increasing ramp waveform voltage is applied to even-numbered scan electrode $SC_{p+1}$ in the first half of the even-numbered line initialization time period, the wall voltages work in the canceling direction of the ramp waveform voltage. Therefore, discharge does not occur, or even if discharge occurs the wall voltages are not largely reduced. Even when the decreasing ramp waveform voltage is further applied to even-numbered scan electrode $SC_{p+1}$ in the last half of the even-numbered line initialization time period, voltage Vr for suppressing discharge is applied to odd-numbered scan electrode $SC_p$. Therefore, discharge does not occur in this electrode, or even if discharge occurs the wall voltages are not largely reduced.

In the subsequent even-numbered line writing time period, negative scan pulse voltage Va is further applied to even-numbered scan electrode $SC_{p+1}$ on which the negative wall voltage has been accumulated, and positive voltage Vq is further applied to odd-numbered scan electrode $SC_p$ on which the positive wall voltage has been accumulated, thereby causing priming discharge. The wall voltages are thus added to the voltages that have been applied to the electrodes, so that the priming discharge at this time also becomes stable and its discharge delay is reduced. Then, positive wall voltage is accumulated on even-numbered scan electrode $SC_{p+1}$ and negative wall voltage is accumulated on odd-numbered scan electrode $SC_p$ in priming discharge cell $PS_p$.

The driving method of the panel of the second exemplary embodiment of the present invention employs the subfields where the initialization time period is temporally separately divided into the odd-numbered line initialization time period and the even-numbered line initialization time period, as discussed above. Therefore, the priming discharge in the writing time period of the first subfield also becomes stable, and its discharge delay is reduced.

The odd-numbered line initialization time period and the even-numbered line initialization time period do not need to be disposed in every subfield. When one set of the time periods is simply disposed per one field or several fields, for example, the priming discharge can be stabilized.

The present invention can provide a driving method of a plasma display panel capable of stably causing the writing discharge without reducing the driving voltage margin of the writing operation.

INDUSTRIAL APPLICABILITY

In a driving method of a panel of the present invention, writing discharge can be stably caused without reducing the driving voltage margin of the writing operation, so that this driving method is useful as a driving method of a panel used in a wall-mounted TV or a large monitor.

The invention claimed is:

1. A driving method of a plasma display panel, the plasma display panel comprising:

a first substrate;

a plurality of display electrode pairs that are disposed on the first substrate and formed of scan electrodes and sustain electrodes, the scan electrodes and the sustain electrodes being arranged alternately by two and in parallel;

a second substrate faced to the first substrate through a discharge space;

a plurality of data electrodes disposed on the second substrate and in a direction crossing the display electrode pairs; and a barrier rib disposed between the first substrate and the second substrate so as to separate main discharge cells for causing main discharge and priming discharge cells for causing priming discharge with two adjacent scan electrodes of the plurality of scan electrodes, each of the main discharge cells being formed of the display electrode pair and the data electrode, the driving method of the plasma display panel comprising:

forming one field including a plurality of subfields having an initialization time period, a writing time period, and a sustaining time period;

dividing the writing time period into an odd-numbered line writing time period and an even-numbered line writing time period, a writing operation being performed in the main discharge cell having an odd-numbered scan electrode in the odd-numbered line writing time period, a writing operation being performed in the main discharge cell having an even-numbered scan electrode in the even-numbered line writing time period;

sequentially applying a scan pulse to an odd-numbered scan electrode and applying voltage to an even-numbered scan electrode in the odd-numbered line writing time period, the voltage being used for causing priming discharge in the priming discharge cell between the even-numbered scan electrode and the odd-numbered scan electrode to which the scan pulse has been applied; and sequentially applying a scan pulse to an even-numbered scan electrode and applying voltage to an odd-numbered scan electrode in the even-numbered line writing time period, the voltage being used for causing priming discharge in the priming discharge cell between the odd-numbered scan electrode and the even-numbered scan electrode to which the scan pulse has been applied.

2. The driving method of the plasma display panel according to claim 1, wherein in at least one of the plurality of subfields, the initialization time period has an odd-numbered line initialization time period and an even-numbered line initialization time period, an initializing operation being performed in the main discharge cell having an odd-numbered scan electrode in the odd-numbered line initialization time period, an initializing operation being performed in the main discharge cell having an even-numbered scan electrode in the even-numbered line initialization time period, and the odd-numbered line initialization time period is disposed just before the odd-numbered line writing time period, and the even-numbered line initialization time period is disposed just before the even-numbered line writing time period.

* * * * *